United States Patent [19]

Dunning

[11] 3,953,635

[45] *Apr. 27, 1976

[54] HOT STAMP TAPE

[75] Inventor: Richard E. Dunning, Munster, Ind.

[73] Assignee: Avery Products Corporation, San Marino, Calif.

[ * ] Notice: The portion of the term of this patent subsequent to May 30, 1989, has been disclaimed.

[22] Filed: July 12, 1974

[21] Appl. No.: 487,925

Related U.S. Application Data

[60] Continuation of Ser. No. 338,238, March 5, 1973, abandoned, which is a continuation of Ser. No. 233,463, March 10, 1972, abandoned, which is a division of Ser. No. 188,423, Oct. 12, 1971, Pat. No. 3,666,516.

[52] U.S. Cl. ..... 428/151; 156/61; 156/231; 156/232; 156/238; 156/239; 156/240; 427/148; 427/258; 427/267; 428/152; 428/162; 428/200; 428/207; 428/349; 428/352; 428/353; 428/354; 428/914

[51] Int. Cl.[2] ..... B44C 1/16; B44C 1/20; D41M 3/12

[58] Field of Search ..... 156/61, 231, 232, 238, 156/239, 240; 161/406, 406 T, 120, 167; 117/3.4, 8, 45; 427/148, 258, 267; 428/151, 152, 162, 200, 207, 349, 354

[56] References Cited

UNITED STATES PATENTS

| | | | |
|---|---|---|---|
| 2,556,078 | 6/1951 | Francis | 156/238 |
| 2,654,687 | 10/1953 | Fridolph | 156/239 |
| 3,351,510 | 11/1967 | Harris | 156/232 |
| 3,551,177 | 12/1970 | Hechtman et al. | 428/162 |
| 3,666,516 | 5/1972 | Dunning | 117/3.4 |
| 3,834,925 | 9/1974 | Matsumura | 161/406 |

FOREIGN PATENTS OR APPLICATIONS

| | | |
|---|---|---|
| 702,572 | 1/1954 | United Kingdom |

*Primary Examiner*—J. C. Cannon
*Attorney, Agent, or Firm*—Christie, Parker & Hale

[57] ABSTRACT

A web of indeterminate length carrying thermally transferable material, usually referred to as hot stamp tape, is structured to provide an improved simulated wood grain pattern on a substrate after transfer to the substrate of transferable portions of the tape. The web or tape may be provided in sheet form. The structure comprises "ticks" or discrete linearly oriented spots of material having low specular reflectivity coated on a matte carrier sheet, as by printing, and a layer coated thereon to provide the top layer of the transferred material, which replicates the surface of the carrier sheet and the coated "ticks" or spots.

33 Claims, 4 Drawing Figures

HOT STAMP TAPE

CROSS-REFERENCES

This application is a continuation of application Ser. No. 338,238, filed Mar. 5, 1973 and now abandoned which, in turn, is a continuation of Ser. No. 233,463, filed Mar. 10, 1972 and now abandoned which, in turn, is a division of Ser. No. 188,423, filed Oct. 12, 1971, now U.S. Pat. No. 3,666,516.

FIELD

This invention relates to hot stamp tapes and more particularly to webs comprising heat transferable coatings.

PRIOR ART

The instant invention represents an improvement on the disclosures of the following patents:

| U. S. Patent No. | Patentee | Classification |
|---|---|---|
| 3,467,538 | Best | 117-8 |
| 3,054,715 | White | 156-233 |
| 3,252,847 | Morgan | 156-233 |
| 3,434,862 | Luc | 156-234X |

SUMMARY

Simulated woodgrain patterns have been provided on many surfaces in recent years. Examples include countertops, wall panels, cupboard doors, radio cabinets and the like. Many of these have been provided by printing a woodgrain pattern on paper, laminating the paper to a substrate and covering the paper with a layer of synthetic resinous material. This has been particularly true in the case of countertops and wall panels.

In other instances, a woodgrain pattern has been provided in a transferable layer of a hot stamp tape (or web) and then, by hot stamp transfer, the transferable portion including the woodgrain patterned layer has been transferred to and adhered to a substrate.

More recently, in order to better simulate the grain of wood, it has become common to emboss linearly oriented spaced-apart depressions into the surface during or after transfer, the embossed portions being referred to in the art as ticks. Alternatively it has been well-known to provide the substrate with such ticks by molding or embossment prior to applying a coating thereto and then forcing the coating down into the ticks.

Ticks which have been provided in this manner have aided in providing a realistic simulation of a wood grain but have not been considered to provide optimum simulation.

In accordance with the present invention, it has been found that a highly non-specularly reflective surface portion of a coated surface more nearly simulates to the eye the natural tick appearing in actual woodgrain than does a mere depression. The actual ticks in actual wood appear to be partially depressed as is the case with embossment. However, they also differ very markedly; that is, to an extremely high degree, in specular reflectivity with respect to the portions of wood immediately adjacent the ticks. This latter property appears to be far more important in providing optimum simulation of the grain patterns of actual wood than does providing a depression as in the case of either embossment or molding of depressions in the substrate.

Thus, both the discovery involved in recognizing this fact and also the structure and method for providing improved simulated wood grain patterns constitute parts of the instant invention. Prior to the instant invention, it had not been possible to provide simulation of such non-specular reflectivity characteristics.

Accordingly, I shall describe a preferred embodiment of my invention to provide ticks which are substantially or nearly non-specularly reflective; that is, have a specular reflectance below a value of 25% at 60°.

I first provide a carrier sheet or web which may be any carrier sheet or web of the prior art; for example, a polyester film such as "Mylar" (trademark of DuPont), "Melinex" (trademark of Imperial Chemical Industries), or a web of cellophane or cellulose acetate or paper. I prefer to utilize a polyester film, particularly Mylar and I have found that to provide optimum results, I may provide this film as matte surfaced Mylar. A matte-surfaced Mylar may be provided by incorporating an inert particulate substance in the formulation during early stages of manufacture which affects the surface during later biaxial orientation or by embossment or sand-blasting or chemical coating.

The carrier may then be coated on one surface with discrete spaced apart portions or ticks of a layer of synthetic resinous material in such fashion as to provide on the surface of each tick, a surface having very low specular reflectance. If desired, a primer coat may first be applied in the pattern of the ticks and the tick coat applied on top of and in register with the primer coat. Coating may be accomplished by any suitable means such as by silk screening or spraying through a mask or by gravure printing or printing from the surfaces of characters. The composition is one which shrinks during drying to provide a sufficiently crinkled or otherwise irregular and non-glossy surface to provide the desired low degree of specular reflectivity. The discrete spaced apart portions or ticks are non-heat-transferably adherently attached to said carrier sheet, so that they will not transfer from the carrier sheet when subjected to the heat and pressure of the transfer operation.

A release coating may then be applied which may be of conventional form and may thus be based on paraffin wax or the like. The normal characteristics of a release coating are that it melts or softens at a temperature below that of other layers in the sheet so that neither the carrier portion which remains behind or the transferred portion (which may be one layer or may be as many as eight or ten layers) is melted or softened, except that the surface of the layer adjacent the substrate is sufficiently softened or made sufficiently tacky to provide adherence to the substrate.

Extreme thinness of the release coating is absolutely essential if not entirely critical. Thus, the release coating must be relatively thin relative to the size of the bumps in the nearly non-specularly reflective surface of the coated ticks, to permit subsequent replication of these bumps.

A layer of replicating synthetic resinous material is then coated relatively thickly over the release coating so that the thickness of each heretofore coated tick is either somewhat less or at least not much greater than the thickness of this newly coated layer, the newly coated layer being of synthetic resinous material suited to replicate the surface of the carrier sheet and the surfaces of the heretofore coated ticks. This layer may carry coloring material or may be transparent and may be adapted to be adhered directly to a substrate or may be provided with additional layers which may comprise coloring material and/or tackiness characteristics for providing ahderence to a substrate.

For example, it is normal to provide a simulated woodgrain pattern as a plurality of printings of different colors overlying each other and a coating is necessary for each such color. Coatings embodying all these colors may be placed over the replicating coating and the last of such color-containing coatings or an additional coating may be of a composition that provides the desired degree of tackiness during heat transfer to provide adhesion to the substrate.

Although carrier sheets either having a high degree of specular reflectivity, that is, being highly glossy or having a matte surface, that is, having a lower degree of specular reflectivity, have been described, the carrier sheet surface may have any suitable degree of specular reflectivity desired for any particular purpose.

This invention is not limited to providing simulated woodgrain patterns but may be utilized to provide any desired pattern having coated surface portions which vary greatly in specular reflectivity. Thus, on a carrier sheet having high, medium or low specular reflectivity, there may be coated not only one group of ticks having a particular set of surface characteristics, but there may also be coated additional groups of ticks to provide any desired number of groups, each group having a particular surface characteristic or characteristics which need not be the same as that of any other group coated thereon.

The replicatory coat then replicates all characteristics of all the surfaces presented by all such ticks or other coating portions coated thereon, plus the uncoated exposed portions of the carrier sheet.

OBJECTS

It is, therefore, an object to provide a hot stamp tape or web suitable for providing an improved simulated woodgrain pattern on a substrate.

Another object is such a web comprising coating ticks having low specular reflectivity and a replicating coating adapted to provide portions having corresponding low specular reflectivity after transfer.

Another object is to provide such a replicatory coat with two different degrees of reduced specular reflectivity.

Further objects will become apparent from the description.

DRAWINGS

In the drawings like reference numerals refer to like parts and:

DESCRIPTION

Figure 1:
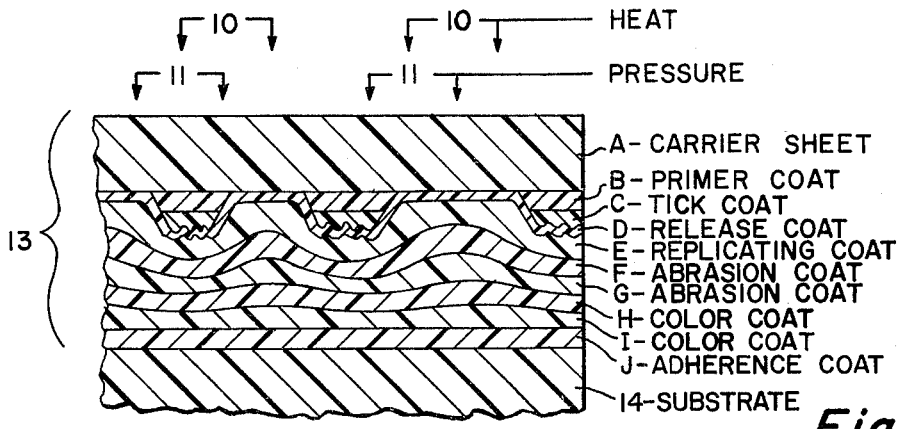
FIG. 1 is a cross-sectional schematic view of one embodiment of the method and article of the invention.

Referring now to FIG. 1, a carrier sheet A may be provided with primer coat portions B which may be provided thereover with tick coat portions C. A release coat D may then be provided and overlying the release coat there may be provided respectively a replicating layer E, an abrasion resistant layer F, a second abrasion resistant layer G, a color coat H, another color coat I, and an adherence promoting coat J.

Figure 2:
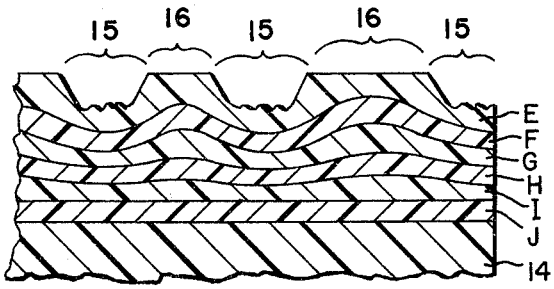
FIG. 2 is a cross-sectional schematic view of the embodiment of FIG. 1 after completion of the process.

Heat as indicated by arrows 10 and pressure as indicated by arrows 11 may be applied to force the laminar assembly 13, consisting of layers A thru J as described, against substrate 14. After thus applying heat and pressure, the carrier sheet and layers B and C and D attached thereto, may be removed to provide the article of FIG. 2, wherein areas of low specular reflectance are indicated at 15 and areas of specular reflectance differeing therefrom are indicated at 16.

Figure 3:
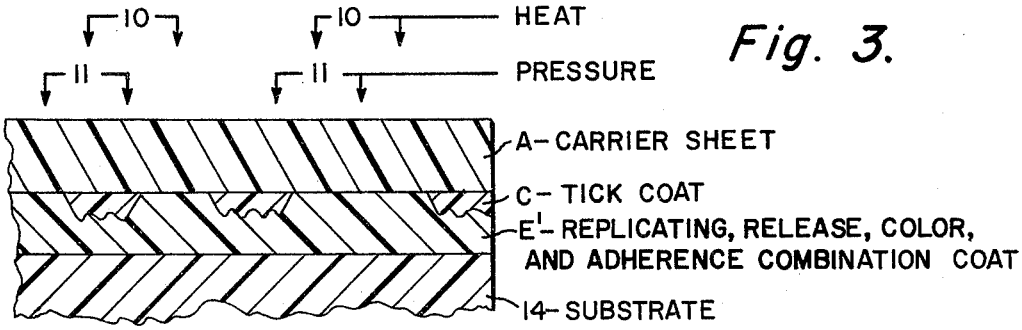
FIG. 3 is a cross-sectional schematic view of another embodiment of the process and article.
Figure 4:
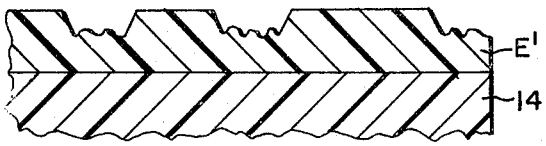
FIG. 4 is a cross-sectional schematic view of the embodiment of FIG. 3 after completion of the process.

In FIG. 3 is shown an embodiment corresponding to that of FIG. 1 wherein many layers are omitted, layer E provides a combination replicating, release, color, and adherence coat. In FIG. 4 is shown the article which remains after completing the process of FIG. 3 and removing sheet A having coating C attached thereto.

Coatings B and C are preferably applied by gravure printing but may be applied by silk screen printing, letter press printing, or the like. All other coats or layers may be applied by any suitable coating means such as by Meyer rod or reverse roller coater.

Below are given specific examples of suitable formulations for each coating layer together with particular characteristics thereof.

The carrier sheet which is preferably in web or tape form may be, as described above, a polyester film such as Mylar or a web of cellophane or cellulose accetate or paper. Mylar having a thickness of from ½ mil to 2 mils is preferred. For a preferred embodiment, it is desired to provide matte Mylar having a specular reflectance at 60° to the horizontal in accordance with ASTM standard D523 of 35% to 60% but in certain embodiments glossy or non matte Mylar which has a specular reflectance determined in like manner of on the order of above 90% and generally on the order of 95% or above may be used.

In Table I are shown the layers present in the various examples. Since the following three layers carrier sheet, tick coat, and replicating coat are present in all examples, these are not included in the table so that Table I only relates to nine examples although thirteen examples are presented; in the examples 10, 11, 12, and 13, the only layers present are carrier, tick coat, and replicating coat.

The primer coat as provided serves the purpose of providing for improved adherence between the tick coat and the carrier sheet and it may be omitted if adherence of the tick coat to the carrier sheet is adequate without the presence of the primer coat.

The release coat is generally preferably a material such as a wax or the like; either natural wax, paraffin wax, or a mixture of thereof, or a mixture of wax with other substances, may be used; but it is generally a waxy substance characterized by having a softening range rather than a clear softening point. The softening range or softening point of the release coat is generally preferably lower than the melting or softening points of the carrier sheet and all other layers in the laminar assembly so that when subjected to heat the softness of the release coat when heated permits the replicating coat to be released therefrom.

The replicating coat may in suitable instances be provided with release properties so that when subjected to suitable heat and pressure during hot stamping it is suitably released from the carrier sheet without the presence of a separate and a distinct release coat.

Abrasion resisting coats have the obvious function of providing enhanced abrasion resistance and either or both may be omitted if the replicating layer provides sufficient abrasion resistance in and of itself. Color coats are generally printed on. Generally at least two color coats are necessary if a suitable wood grain or simulated wood grain pattern is to be provided and often three color coats may suitably be utilized for the purpose of providing an attractive and suitable simulated wood grain pattern; however, for providing other patterns which are not simulated wood grain patterns, it may in many instances be suitable to provide only a single color coat or to provide sufficient coloring material in the replicating layer so that no individual color coat is necessary. In some instances, in fact, if no color is desired in the surface finish, no coloring material at all need be incorporated. The purpose of the adherence layer is to promote or improve adherence of the laminar assembly to a substrate, and an adherence coat need be provided only if the adherence is otherwise unsatisfactory.

In Table I, the presence of an X in a column indicates that a coating or layer is present in the example heading the column, and the absence of an X indicates the absence of a corresponding layer.

TABLE I

| Coat: | Example 1 | 2 | 3 | 4 | 5 | 6 | 7 | 8 | 9 |
|---|---|---|---|---|---|---|---|---|---|
| B primer | X | X | X | X | X | X | | | |
| D release | X | X | X | X | | X | | | X |
| F abrasion | X | | | | | | | | |
| G abrasion | X | | | | | | | | |
| H color | X | X | X | X | X | X | X | X | X |
| I color | X | X | X | X | X | X | X | X | |
| J adherence | X | X | | | | | | | |

Examples 1 to 8 are suitable for providing two-color patterns, if the color coats are printed, which may be simulated wood-grain patterns, simulated leather patterns and the like.

Coat B — Primer Coat, parts by weight

| | Example 1 | 2 | 3 | 4 | 5 | 6 |
|---|---|---|---|---|---|---|
| dimethyl formamide | | | 45 | | | 45 |
| Goodyear "Vitel" soluble polyester resin, PE 200 | 10 | | | 5 | | |
| Union Carbide VAGH vinyl resin | | 10 | | | 5 | |
| Union Carbide VMCH vinyl resin | | | 10 | | | 10 |
| dioxane | 45 | 45 | | 62 | | |
| chloroform | 45 | 45 | | 33 | | |
| tetrahydro furan | | | 45 | | 95 | 45 |
| cure temp., °F. | 250 | 250 | 275 | 250 | 250 | 275 |
| cure time, seconds | 7 | 7 | 7 | 7 | 7 | 7 |
| thickness, or wt., wet, lbs. per ream | 4 | 3 | 6 | 8 | 9 | 6 |

Coat C — Tick Coat, parts by weight (dry thickness 5 to 20 microns)

| Ingredient or Condition | Example 1 | 2 | 3 | 4 | 5 | 6 | 7 | 8 | 9 | 10 | 11 | 12 | 1 |
|---|---|---|---|---|---|---|---|---|---|---|---|---|---|
| American Cyanamid "Beetle" urea formaldehyde resin, 212-9 | 20 | | | 10 | | | | | | | | | |
| American Cyanamid "Beetle" urea formaldehyde resin, 220-8 | | | | | | | | | 20 | 12 | | | 1 |
| American Cyanamid Melmac, Melamine resin, 243-3 | | 25 | | | 18 | | | | | | | | |
| HCl | 1 | | | .5 | 1 | | | | .5 | | | | |
| Union Carbide VMCH copolymer of 85 to 88% vinyl chloride, 10.8 to 14.2% vinyl acetate and .8 to 1.2% maleic acid | | | | | | | | | | | 13.5 | 20 | |
| Rohm and Haas at-50 thermosetting acrylic | | | 30 | | | 12 | | | | | | | |
| Johns Manville Celite diatomaceous earth | 9 | | 11 | | | | | | | 10 | 8 | 10 | |
| Monsanto Santocel FRC, fumed silica | | 2 | | | | 3 | | | 5 | | | | |
| Union Carbide VAGD vinyl resin copolymer of 89.5 to 91.5% vinyl chloride, 2.0 to 5.3% vinyl acetate and 5.2 to 6.5% vinyl alcohol | | | | | | | | 11 | | | | | |
| union Carbide VAGH vinyl resin same as VAGD vinyl resin except higher molecular weight | | | | | | | 11 | | | 11 | | | |
| aluminum silicate | | | | 6 | 4 | | | | | | | | |
| p-toluene sulfonic acid | | 2 | | | | | | | | 1 | | | |
| methyl isobutyl ketone | | | | | | | 40 | 35 | | 13 | 45 | 34 | |
| zylol | 70 | | 59 | 28.5 | 27 | 85 | | | | | | | |
| butanol | | 40 | | | | | | | | | | | |
| Dow Corning 704 silicone resin | | | | | | | | | | | 1 | 1 | |
| benzene | | 31 | | 55 | 50 | | 35 | 40 | 74.5 | 53 | 32.5 | 35 | 4 |
| Bakelite 2774 ERL catalyst | | | | | | | 1 | 1 | | | | | |
| polyurethane, prepolymer | | | | | | | 13 | 13 | | | | | |
| cure time | 1 min. | 1 min. | 30 min. | 2 min. | 2 min. | 1.5 min. | 24 hrs. | 4 hrs. | 1 min. | 45 sec. | 20 sec. | 20 sec. | 5 se |
| cure temp., °F. | 350 | 350 | 250 | 300 | 300 | 325 | 120 | 120 | 250 | 245 | 275 | 275 | 24 |

Coat D — Release Coat, parts by weight, 1 to 4 pounds per ream, wet

| | Example 1 | 2 | 3 | 4 |
|---|---|---|---|---|
| petroleum wax, $C_{43}H_{88}$ | 5 | | | .5 |
| petroleum wax, $C_{41}H_{84}$ | | 4 | | |
| montan wax | | | 7 | |
| ethyl hydroxyethyl cellulose | | | | 5 |
| benzene | 95 | 96 | 50 | 48 |

Coat G — Abrasion Coat
Example 1, parts by weight

| | |
|---|---|
| Methyl methacrylate | 10 |
| aluminum oxide | 8 |
| acetone | 78 |
| cure: 30 seconds at 200°F. | |
| coating weight, wet: 45 lbs./ream | |

Coat H — First Color Coat, parts by weight (cure at 180°F. to 220°F. for 4 to 20 seconds)

| | Example 1 | 2 | 3 | 4 | 5 | 6 | 7 | 8 | 9** |
|---|---|---|---|---|---|---|---|---|---|
| Methyl methacrylate | 10 | | | 20 | | | 15 | | |
| Vinyl Chloride resin | | 10 | | | | | | 12 | |
| Nitrocellulose, ½ sec RS | | | | | 9 | 12 | | | |
| Me methacrylate - Bu methacrylate copolymer | | | 21 | | | | | | 16 |
| Ti $O_2$ | | | 1.2 | | | | 3 | | 16 |
| Molybdate orange | .5 | 1 | | | | | | | 4 |
| carbon black | 1 | .5 | 1.2 | 2 | .5 | .7 | 1 | 1 | 1 |
| acetone | | 88.5 | 48.6 | 78 | 30.5 | 29.3 | 81 | 87 | 21 |
| benzene | 88.5 | | | | | | | | 21 |
| methanol | | | 28 | | 60 | 58 | | | 21 |
| coating weights, wet, lbs./ream | * | * | * | * | * | * | * | * | 40 |

*depends on pattern
**single color

| | | | | | | | | | |
|---|---|---|---|---|---|---|---|---|---|
| C $Cl_4$ | 93 | 45 | | | | | | | |
| methyl ethyl ketone | | | 48 | | | | | | |
| trichloroethylene | | 99.5 | | | | | | | |

Coat I — Second Color Coat, parts by weight (coating weights depend on pattern, cure at 180°F. to 220°F. for 4 to 20 seconds)
Example Coat E — Replicating Coat, parts by weight

| | Example 1 | 2 | 3 | 4 | 5 | 6 | 7 | 8 | 9 | 10 | 11* | 12** | 13* |
|---|---|---|---|---|---|---|---|---|---|---|---|---|---|
| Union Carbide VYHH vinyl resin copolymer of about 13% vinyl acetate and about 87% vinyl chloride, medium molecular weight** | 17 | 12 | | | | | 4 | | 15 | 4 | | | |
| Nitrocellulose ½ sec R.S. | | | 18 | 13 | | | | 5 | | | 3 | | |
| Methyl methacrylate, medium molecular wt. | | | | | 20 | 15 | 14 | 12 | | 13 | 14 | 20 | 10 |
| Ti $O_2$ | | | | | | | | | | | 17 | | |
| Iron oxide red | | | | | | | | | | 15 | | | 10 |
| butanol | | | 55 | | | | | 28 | | | | | |
| benzene | 50 | 88 | | 29 | 80 | | 41 | | 85 | 34 | | 80 | 80 |
| acetone | 33 | | 27 | 58 | | 85 | 41 | 55 | | 34 | 66 | | |
| cure time, seconds | 40 | 40 | 30 | 30 | 27 | 25 | 30 | 10 | 10 | 5 | 7 | 10 | 10 |
| cure temp, ° F. | 180 | 180 | 200 | 200 | 205 | 200 | 200 | 225 | 230 | 240 | 220 | 215 | 215 |
| coating weights, wet pounds/ream | 30 | 40 | 30 | 45 | 10 | 12 | 15 | 30 | 20 | 20 | 20 | 40 | 45 |

*single uniform color.
**clear

Coat F — Abrasion Coat
Example 1, parts by weight

| | |
|---|---|
| Polyethylene, micronized | 7 |
| Union Carbide vinyl resin VYNS medium-high molecular weight copolymer of 9.5% to 11.5% vinyl acetate and balance vinyl chloride | 14 |
| acetone | 50 |
| benzene | 29 |
| cure 5 seconds at 260°F. | |
| coating weight, wet: 15 lbs./ream | |

| | 1 | 2 | 3 | 4 | 5 | 6 | 7 | 8 |
|---|---|---|---|---|---|---|---|---|
| Vinyl chloride resin | 10 | 20 | | | 8 | 22 | | |
| Me methacrylate-butyl methacrylate copolymer | | | 10 | 20 | | | 8 | 22 |
| Iron oxide red | | | | | | | | |
| Molybdate orange | 5 | 10 | 4 | 9 | 4 | 4 | 4 | 4 |
| Chrome yellow | 5 | 10 | 2 | 1 | 3 | 12 | 3 | 12 |
| $TiO_2$ | 1 | | 1 | 2 | 1 | 3 | 1 | 3 |
| carbon black | | | 1 | 2 | 1 | 1 | 1 | 1 |
| acetone | 79 | 60 | | 44 | 83 | 58 | | |
| benzene | | | 82 | | | | 83 | 58 |
| methanol | | | | 22 | | | | |

I claim:

1. A hot transfer sheet comprising a carrier layer, and a transfer layer which is stably associated with the carrier layer at ambient temperatures, but which is dissociable therefrom under heat transfer conditions;

said carrier layer being formed from a flexible, foldable material;

said carrier layer having a plurality of discrete spaced apart portions of thermoset resin coated on the surface thereof, attached thereto, and non-transferable therefrom under normal heat transfer conditions;

said surface of said carrier layer having portions which are not coated with said thermoset resin;

said spaced apart thermoset resin portions having surfaces remote from the surface of said carrier layer which have a specular reflectance which is different from the specular reflectance of the portions of the surface of the carrier which are not coated with said thermoset resin;

said transfer layer comprising a thermoplastic synthetic resinous material overlaying the surface of the carrier layer and said remote surfaces of said thermoset resin portions coated thereon;

said overlaying transfer layer being of sufficient thickness to replicate said portions of the surface of the carrier layer uncoated with said thermoset resin portions as well as the surfaces of said thermoset resin portions remote from the surface of said carrier layer;

said transfer layer replicating the surfaces of the thermoset resin portions without said thermoset resin portions transferring from the carrier layer;

said overlaying transfer layer being capable of adhering to a substrate of choice under conditions of heat transfer.

2. A laminate according to claim 1 in which said remote surfaces are irregularly shaped to provide a lower specular reflectance than that of the carrier sheet surface.

3. A hot transfer sheet according to claim 1 which provides a simulated wood grain finish, said spaced apart thermoset resin portions being formed from a material providing said remote surfaces thereof with a lower specular reflectance than that of the uncoated portions of the surface of the carrier layer, and including at least two printed pigmented layers associated with the transferable layer.

4. A hot transfer sheet according to claim 1 in which the spaced apart portions of thermoset resin comprises an amino aldehyde resin.

5. A hot transfer sheet according to claim 1 in which the spaced apart portions of thermoset resin comprises an urea aldehyde resin.

6. A hot transfer sheet according to claim 1 in which the spaced apart portions of thermoset resin comprises a melamine aldehyde resin.

7. A hot transfer sheet according to claim 1 in which said surfaces of said carrier layer is a matte surface.

8. A hot transfer sheet according to claim 1 including portions of a primer coating between the carrier layer and the discrete portions of thermoset resin in register with said thermoset resin portions, and a thin release coating layer overlaying the carrier layer and the discrete portions and underlying the transferable layer.

9. A hot transfer sheet according to claim 1 in which the transferable layer is transparent and is coated with at least one additional layer comprising coloring material.

10. A hot transfer sheet according to claim 1 in which the transfer layer is tacky when heated under normal heat transfer conditions to provide means for adherence to a substrate.

11. A hot transfer sheet according to claim 1 in which said spaced apart portions of thermoset resin were coated onto the carrier sheet in a fluid condition and shrunk during drying to form irregularly shaped remote surfaces having a lower specular reflectance than that of the uncoated portions of the surface of the carrier layer.

12. A hot transfer sheet according to claim 11 in which the spaced apart thermoset resin portions include a fine particulate filler.

13. A hot transfer sheet according to claim 12 in which the spaced apart thermoset resin portions have a thickness in the range of about 5 to about 20 microns.

14. A hot transfer sheet according to claim 1 in which the spaced apart portions of thermoset resin include an amino aldehyde resin, and a synthetic resinous material which includes a copolymer of vinyl chloride, vinyl acetate, and a monomer copolymerizable therewith.

15. A hot transfer sheet according to claim 14 in which the monomer is maleic acid.

16. A hot transfer sheet according to claim 14 in which the monomer is vinyl alcohol, and prepolymeric polyurethane is included as a component.

17. A hot transfer sheet according to claim 14 in which the monomer is vinyl alcohol.

18. A laminate for providing on a substrate a decorative finish having a surface characterized by discrete spaced apart portions which vary in specular reflectance from other portions of the surface comprising:

a heat-resistant, flexible, foldable carrier sheet having a surface having a predetermined specular reflectance;

a plurality of discrete spaced apart portions of thermoset resin coated on a portion of the surface of the carrier sheet, attached thereto, and non-transferable therefrom under normal heat transfer conditions;

said spaced apart portions of thermoset resin having surfaces remote from the surface of the carrier sheet which have a specular reflectance different from that of the portions of the surface of the carrier which are not coated by the thermoset resin; and a transferable replicating layer overlaying the carrier sheet and said spaced apart thermoset resin portions and comprising a coating of sufficient thickness of a synthetic resinous material to replicate the specular reflectance of the remote surfaces of the spaced apart thermoset resin portions and the specular reflectance of the portions of the carrier sheet surface not coated by said spaced apart portions;

the replicating layer replicating the surfaces of the thermoset resin portions without said thermoset resin portions transferring from the carrier sheet;

said replicating layer being releasable from contact with the carrier sheet and said spaced apart thermoset resin portions to provide a decorative replicating layer having a surface which comprises a plurality of discrete spaced apart portions which vary in specular reflectance from the remaining portion of the surface;

whereby the laminate comprising the carrier sheet and the replicating layer can be applied to a substrate and heated to adhere the replicating layer to the substrate; with the carrier sheet being released from the replicating layer to provide said replicating layer as a surface finish attached to the substrate.

19. A laminate according to claim 18 in which the replicating layer is stably associated with the carrier sheet at ambient temperatures, but is transferable therefrom under heat transfer conditions for being attached to the substrate.

20. A laminate according to claim 18 in which said laminate provides a simulated wood grain finish, said spaced apart thermoset resin portions are formed from a material providing said remote surfaces thereof with a lower specular reflectance than that of the uncoated portions of the surface of the carrier sheet, and at least two printed pigmented layers are associated with the replicating layer.

21. A laminate according to claim 18 in which the replicating layer comprises a thermoplastic synthetic resinous material.

22. A laminate according to claim 18 in which the spaced apart portions of thermoset resin comprise an amino aldehyde resin.

23. A laminate according to claim 18 in which the spaced apart portions of thermoset resin comprise an urea aldehyde resin.

24. A laminate according to claim 18 in which the spaced apart portions of thermoset resin comprise a melamine aldehyde resin.

25. A laminate according to claim 18 in which said remote surfaces are irregularly shaped to provide a lower specular reflectance than that of the carrier sheet surface.

26. A laminate according to claim 18 in which the spaced apart thermoset resin portions include an amino aldehyde resin, and a synthetic resinous material which includes a copolymer of vinyl chloride, vinyl acetate, and a monomer copolymerizable therewith.

27. A laminate according to claim 26 in which the monomer is maleic acid.

28. A laminate according to claim 26 in which the monomer is vinyl alcohol, and prepolymeric polyurethane is included as a component.

29. A laminate according to claim 26 in which the monomer is vinyl alcohol.

30. A laminate according to claim 18 in which the spaced apart portions were coated onto the carrier in a fluid condition and shrunk during drying to form irregularly shaped remote surfaces having a lower specular reflectance than said uncoated portions of the surface of the carrier sheet.

31. A laminate according to claim 30 in which the spaced apart thermoset resin portions include a fine particulate filler.

32. A laminate according to claim 31 in which the spaced apart thermoset resin portions have a thickness in the range of about 5 to about 20 microns.

33. A laminate for providing on a substrate a decorative finish having a surface characterized by discrete spaced apart portions which vary in specular reflectance from other portions of the surface comprising:

a heat-resistant, flexible, foldable carrier sheet having a surface having a predetermined specular reflectance;

a plurality of discrete spaced apart portions of thermoset resin having a fine particulate filler embedded therein and coated on a portion of the surface of the carrier sheet, attached thereto, and non-transferable therefrom when heat and pressure are applied to the carrier sheet;

said spaced apart thrermoset resin portions having been coated onto the carrier in a fluid condition and shrunk during drying to a thickness in the range of about 5 to about 20 microns to form irregularly shaped surfaces remote from the surface of the carrier sheet, which remote surfaces have a specular reflectance lower than that of the portions of the surface of the carrier which are not coated by the thermoset resin portions; and a transferable replicating layer in overlaying contact with the carrier sheet and said spaced apart thermoset resin portions, the replicating layer comprising a coating of sufficient thickness of a synthetic resinous material to replicate the specular reflectance of the remote surfaces of the spaced apart thermoset resin portions and the specular reflectance of the portions of the carrier sheet not coated by said spaced apart portions;

the replicating layer replicating the reflectance of the remote surfaces of the thermoset resin portions without said thermoset resin portions transferring from the carrier sheet;

said replicating layer being releasable from contact with the carrier sheet and said spaced apart thermoset resin portions to provide a decorative replicating layer having a surface having a plurality of discrete spaced apart portions which vary in specular reflectance from the remaining portion of the surface;

whereby a laminate comprising the carrier sheet and the replicating layer can be applied to a substrate and heated to adhere the replicating layer to the substrate, with the carrier sheet being released from the replicating layer to provide said replicating layer as a surface finish attached to the substrate.

* * * * *

UNITED STATES PATENT AND TRADEMARK OFFICE

CERTIFICATE OF CORRECTION

PATENT NO. : 3,953,635

DATED : April 27, 1976

INVENTOR(S) : Richard E. Dunning

It is certified that error appears in the above-identified patent and that said Letters Patent are hereby corrected as shown below:

Col. 4, lines 13-14, "differeing" should be -- differing --.

Col. 6, table "Coat B", the numbers listed under and between Examples 1 and 2 should be UNDER Example 2

Col. 6, table "Coat C", under"Example", after "12" delete "1" and insert -- 13 ---

Col. 5, table "Coat C", Under "Ingredient or Condition", line 8, after "VMCH" insert -- vinyl resin --

Under "Ingredient or Condition", line 19, "union Carbide" should be -- Union Carbide--

Col. 6, table "Coat C", under Example 13, opposite"formaldehyde resin, 220-8, delete "1" and insert --12-- under Example 13, opposite HCl, insert -- .3 -- under Example 13, opposite "benzene" delete "4" and insert -- 45 -- under Example 13, opposite "cure time" delete"5 se" and insert -- 50 sec. -- under Example 13, opposite "cure temp., °F. delete "24" and insert -- 240 --.

UNITED STATES PATENT AND TRADEMARK OFFICE

CERTIFICATE OF CORRECTION

PATENT NO. : 3,953,635

DATED : April 27, 1976

INVENTOR(S) : Richard E. Dunning

It is certified that error appears in the above–identified patent and that said Letters Patent are hereby corrected as shown below:

Col. 7, table "Coat D" reads:

Coat D -- Release Coat, parts by weight, 1 to 4 pounds per ream, wet

| | Example 1 | 2 | 3 | 4 | | |
|---|---|---|---|---|---|---|
| petroleum wax, $C_{44}H_{88}$ | 5 | | | .5 | | |
| petroleum wax, $C_{41}H_{84}$ | | 4 | | | | |
| montan wax | | | 7 | | 5 | |
| ethyl hydroxyethyl cellulose | | | | | | 4 |
| benzene | 95 | 96 | | | 50 | 48 |

Should Be:

below "benzene" insert the following

| | | | | | | |
|---|---|---|---|---|---|---|
| $CCl_4$ | | | 93 | | 45 | |
| Methyl ethyl ketone | | | | | | 48 |
| Trichloroethylene | | | | 99.5 | | |

UNITED STATES PATENT OFFICE

CERTIFICATE OF CORRECTION

PATENT NO. : 3,953,635

DATED : April 27, 1976

INVENTOR(S) : Richard E. Dunning

It is certified that error appears in the above-identified patent and that said Letters Patent are hereby corrected as shown below:

Col. 8, table "Coat I" reads:

Coat I — Second Color Coat, parts by weight (coating weights depend on pattern, cure at 180°F. to 220°F. for 4 to 20 seconds)

Coat E — Replicating Coat, parts by weight

| | Example 1 | 2 | 3 | 4 | 5 | 6 | 7 | 8 | 9 | 10 | 11* | 12** | 13* |
|---|---|---|---|---|---|---|---|---|---|---|---|---|---|
| Union Carbide VYHH vinyl resin copolymer of about 13% vinyl acetate and about 87% vinyl chloride, medium molecular weight** | 17 | 12 | | | | | 4 | | 15 | 4 | | | |
| Nitrocellulose ½ sec R.S. | | | 18 | 13 | | | | 5 | | | 3 | | |
| Methyl methacrylate, medium molecular wt. | | | | | 20 | 15 | 14 | 12 | | 13 | 14 | 20 | 10 |
| $TiO_2$ | | | | | | | | | | | 17 | | |
| Iron oxide red | | | | | | | | | | 15 | | | 10 |
| butanol | | | 55 | | | | | 28 | | | | | |
| benzene | 50 | 88 | | 29 | 80 | | 41 | | 85 | 34 | | 80 | 80 |
| acetone | 33 | | 27 | 58 | | 85 | 41 | 55 | | 34 | 66 | | |
| cure time, seconds | 40 | 40 | 30 | 30 | 27 | 25 | 30 | 10 | 10 | 5 | 7 | 10 | 10 |
| cure temp, ° F. | 180 | 180 | 200 | 200 | 205 | 200 | 200 | 225 | 230 | 240 | 220 | 215 | 215 |
| coating weights, wet pounds/ream | 30 | 40 | 30 | 45 | 10 | 12 | 15 | 30 | 20 | 20 | 20 | 40 | 45 |

*single uniform color.
**clear

Coat F — Abrasion Coat

| | Example 1, parts by weight |
|---|---|
| Polyethylene, micronized | 7 |
| Union Carbide vinyl resin VYNS medium-high molecular weight copolymer of 9.5% to 11.5% vinyl acetate and balance vinyl chloride | 14 |
| acetone | 50 |
| benzene | 29 |
| cure 5 seconds at 260°F. | |
| coating weight, wet: 15 lbs./ream | |

| | 1 | 2 | 3 | 4 | 5 | 6 | 7 | 8 |
|---|---|---|---|---|---|---|---|---|
| Vinyl chloride resin | 10 | 20 | | | 8 | 22 | | |
| Me methacrylate-butyl methacrylate copolymer | | | 10 | 20 | | | 8 | 22 |
| Iron oxide red | | | | | | | | |
| Molybdate orange | 5 | 10 | 4 | 9 | 4 | 4 | 4 | 4 |
| Chrome yellow | 5 | 10 | 2 | 1 | 3 | 12 | 3 | 12 |
| $TiO_2$ | 1 | | 1 | 2 | 1 | 3 | 1 | 3 |
| carbon black | | | 1 | 2 | 1 | 1 | 1 | 1 |
| acetone | 79 | 60 | | 44 | 83 | 58 | | |
| benzene | | | 82 | | | | 83 | 58 |
| methanol | | | | 22 | | | | |

I claim:

1. A hot transfer sheet comprising a carrier layer, and a transfer layer which is stably associated with the car-

UNITED STATES PATENT AND TRADEMARK OFFICE

CERTIFICATE OF CORRECTION

PATENT NO. : 3,953,635

DATED : April 27, 1976

INVENTOR(S) : Richard E. Dunning

It is certified that error appears in the above-identified patent and that said Letters Patent are hereby corrected as shown below:

Col. 8, table "Coat I" should read:

Coat I — Second Color Coat, parts by weight (coating weights depend on pattern, cure at 180°F. to 220°F. for 4 to 20 seconds)

| | Example | | | | | | | |
|---|---|---|---|---|---|---|---|---|
| | 1 | 2 | 3 | 4 | 5 | 6 | 7 | 8 |
| Vinyl chloride resin | 10 | 20 | | | 8 | 22 | | |
| Me methacrylate-butyl methacrylate copolymer | | | 10 | 20 | | | 8 | 22 |
| Iron oxide red | 5 | 10 | 4 | 9 | 4 | 4 | 4 | 4 |
| Molybdate orange | 5 | 10 | 2 | 1 | 3 | 12 | 3 | 12 |
| Chrome yellow | 1 | | 1 | 2 | 1 | 3 | 1 | 3 |
| $TiO_2$ | | | 1 | 2 | 1 | 1 | 1 | 1 |
| carbon black | | | | | | | | |
| acetone | 79 | 60 | | 44 | 83 | 58 | | |
| benzene | | | 82 | | | | 83 | 58 |
| methanol | | | | 22 | | | | |

Coat F — Abrasion Coat

| | Example 1, parts by weight |
|---|---|
| Polyethylene, micronized | 7 |
| Union Carbide vinyl resin VYNS medium-high molecular weight copolymer of 9.5% to 11.5% vinyl acetate and balance vinyl chloride | 14 |
| acetone | 50 |
| benzene | 29 |
| cure 5 seconds at 260°F. | |
| coating weight, wet: 15 lbs./ream | |

I claim:

1. A hot transfer sheet comprising a carrier layer, and a transfer layer which is stably associated with the car- Signed and Sealed this Thirteenth Day of July 1976

[SEAL]

*Attest:*

RUTH C. MASON
*Attesting Officer*

C. MARSHALL DANN
*Commissioner of Patents and Trademarks*